US008147276B2

(12) United States Patent
Wang et al.

(10) Patent No.: US 8,147,276 B2
(45) Date of Patent: Apr. 3, 2012

(54) ELECTRICAL CONNECTOR

(75) Inventors: Yao-Ting Wang, Taipei (TW); Yu-Hung Su, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/872,026

(22) Filed: Aug. 31, 2010

(65) Prior Publication Data

US 2012/0052739 A1 Mar. 1, 2012

(51) Int. Cl.
*H01R 24/00* (2006.01)

(52) U.S. Cl. ..... 439/660

(58) Field of Classification Search ..... 439/660, 439/79, 638

See application file for complete search history.

(56) References Cited

U.S. PATENT DOCUMENTS

| | | | | |
|---|---|---|---|---|
| 7,517,253 | B1 * | 4/2009 | Chiang | 439/660 |
| 7,837,510 | B1 * | 11/2010 | Hung et al. | 439/660 |
| 8,021,195 | B2 * | 9/2011 | He et al. | 439/638 |
| 2010/0093222 | A1 * | 4/2010 | He et al. | 439/638 |

* cited by examiner

*Primary Examiner* — Alexander Gilman
(74) *Attorney, Agent, or Firm* — WPAT, P.C.; Anthony King

(57) ABSTRACT

An electrical connector includes an insulating body having a base portion and a tongue portion extending forward from the base portion, a plurality of terminals disposed in two opposite surfaces of the tongue portion and each having a soldering tail which stretches behind the base portion and further projects upward beyond a top of the base portion, and a lid having a positioning body and a fastening portion protruding forward from the positioning body. The positioning body defines a plurality of positioning apertures spaced from one another and each extending vertically to penetrate through the positioning body. The fastening portion is mounted to the top of the base portion to make the positioning body locate behind the base portion. The soldering tails are inserted in the positioning apertures to be positioned and strengthened by the positioning body, with free ends thereof projecting beyond a top of the positioning body.

8 Claims, 5 Drawing Sheets

ELECTRICAL CONNECTOR

BACKGROUND OF THE INVENTION

1. Field of the Invention

The present invention relates to an electrical connector, and more particularly to an electrical connector capable of firmly positioning soldering tails of terminals.

2. The Related Art

A conventional electrical connector includes an insulating body and a plurality of terminals disposed in the insulating body. The insulating body has a base portion and a tongue portion extending forward from the base portion. The terminal has a fastening strip, a contact portion and a soldering tail connected with two opposite ends of the fastening strip. The soldering tail is perpendicular to the fastening strip and stretches behind the base portion of the insulating body, with a free end projecting beyond a top or bottom of the base portion for being inserted into a printed circuit board. However, the soldering tail is freely hanged in the air without being positioned by any positioning structure. As a result, when the soldering tail is inserted into the printed circuit board, the soldering tail is apt to be curved or fractured that makes the soldering tail fail to be quickly and accurately inserted in the printed circuit board.

SUMMARY OF THE INVENTION

It is an object of the present invention to provide an electrical connector. The electrical connector includes an insulating body having a base portion and a tongue portion extending forward from a front of the base portion, a plurality of terminals and a lid having a positioning body and a fastening portion protruding forward from a front of the positioning body. Each of the terminals has a fastening strip, a contact portion and a soldering tail connected with two opposite ends of the fastening strip. The soldering tail is substantially perpendicular to the fastening strip. The fastening strips are disposed in a top surface and a bottom surface of the tongue portion respectively and spaced from one another along a direction perpendicular to the extending direction of the tongue portion. The fastening strips further pass through the base portion to make the soldering tails stretched behind the base portion and further projected upward beyond a top of the base portion. The positioning body defines a plurality of positioning apertures spaced from one another and each extending vertically to penetrate through the positioning body. The fastening portion is mounted to the top of the base portion of the insulating body to make the positioning body locate behind the base portion. The soldering tails are respectively inserted in the positioning apertures to be positioned and strengthened by the positioning body. Free ends of the soldering tails further project beyond a top of the positioning body.

As described above, the electrical connector of the present invention utilizes the lid to position the soldering tails of the terminals so as to strengthen the soldering tails and further prevent the soldering tails from deformation or fracture, when the soldering tails are inserted into a printed circuit board. So an accurate and efficient assembly can be achieved for the electrical connector and the printed circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
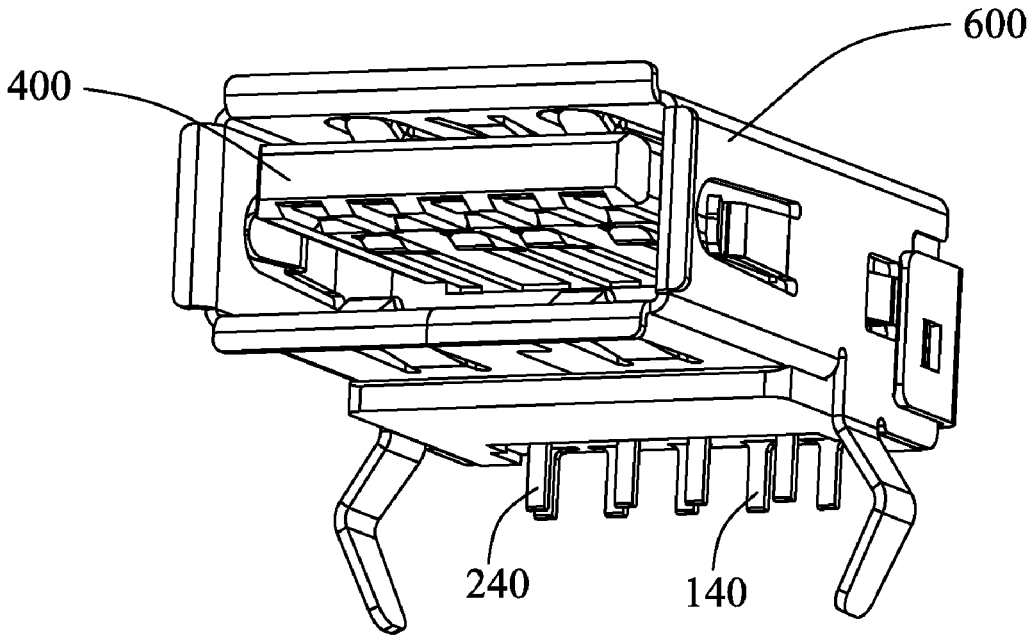
FIG. 1 is a perspective view of an electrical connector in accordance with the present invention.
Figure 2:
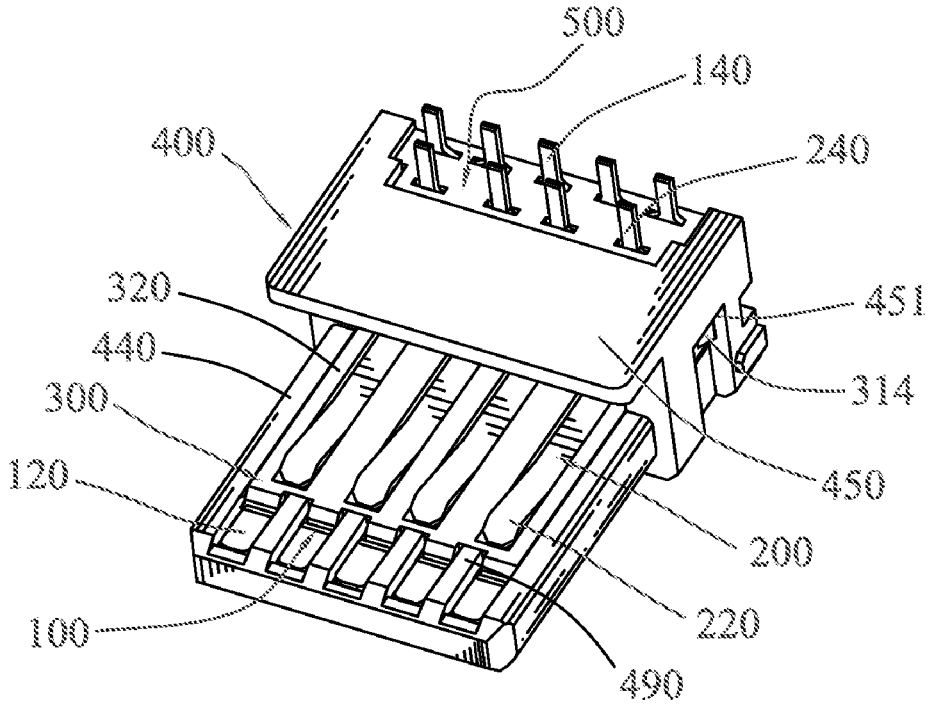
FIG. 2 is a perspective view of the electrical connector of FIG. 1 except a shielding shell.
Figure 3:
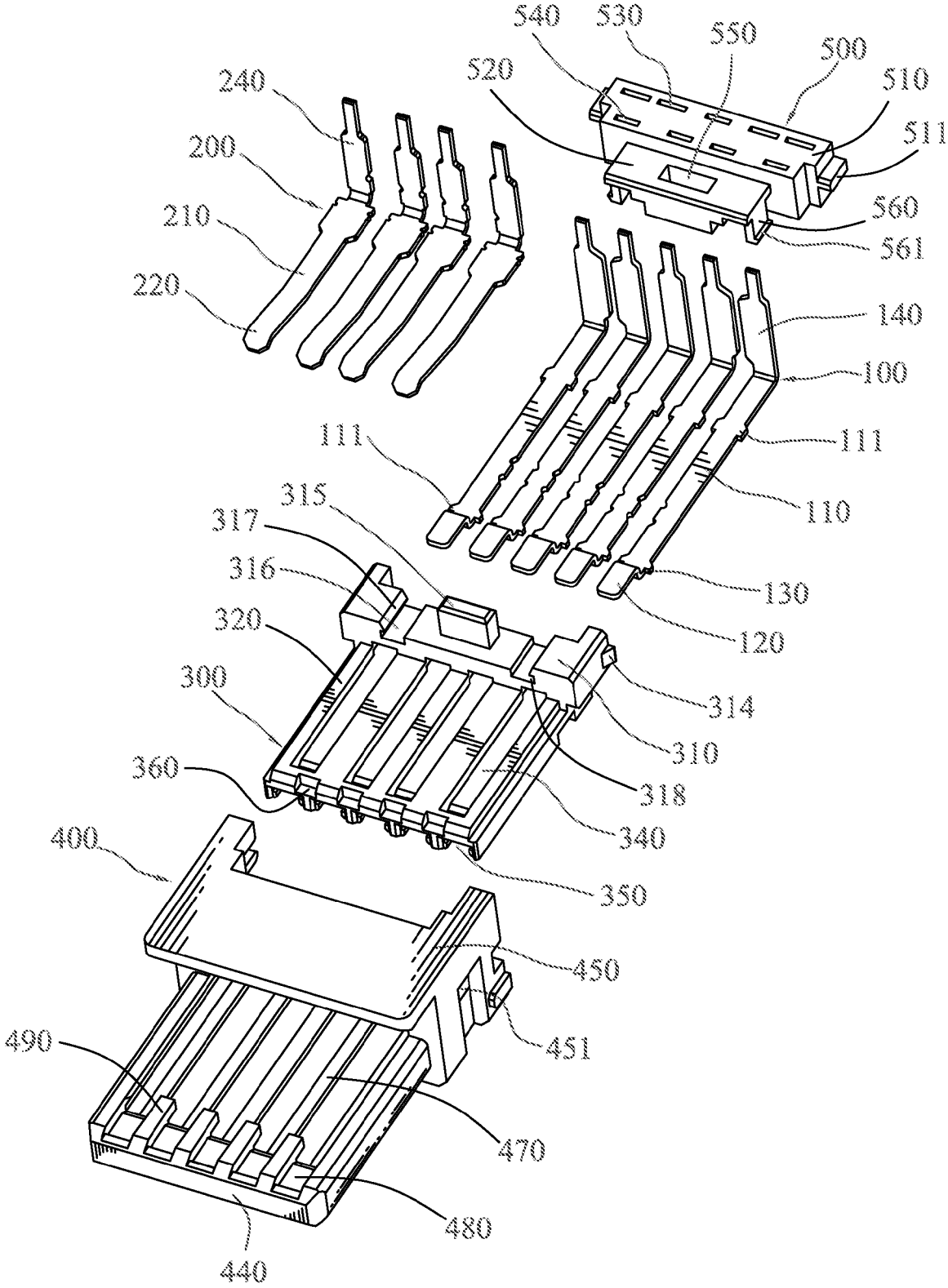
FIGS. 3-5 are exploded perspective views of the electrical connector without the shielding shell of FIG. 2 viewed from three different angles.

Referring to FIG. 1, FIG. 2 and FIG. 3, an electrical connector according to the present invention includes an insulating housing 400, an insulating body 300 mounted to the insulating housing 400, a plurality of first terminals 200 disposed in the insulating body 300, a plurality of second terminals 100 disposed in the insulating body 300 and propped by the insulating housing 400, a lid 500 mounted to a rear of the insulating body 300 for positioning and strengthening first and second soldering tails 240, 140 of the first terminals 200 and the second terminals 100, and a shielding shell 600 surrounding the insulating body 300, the insulating housing 400 and the lid 500.

Figure 4:
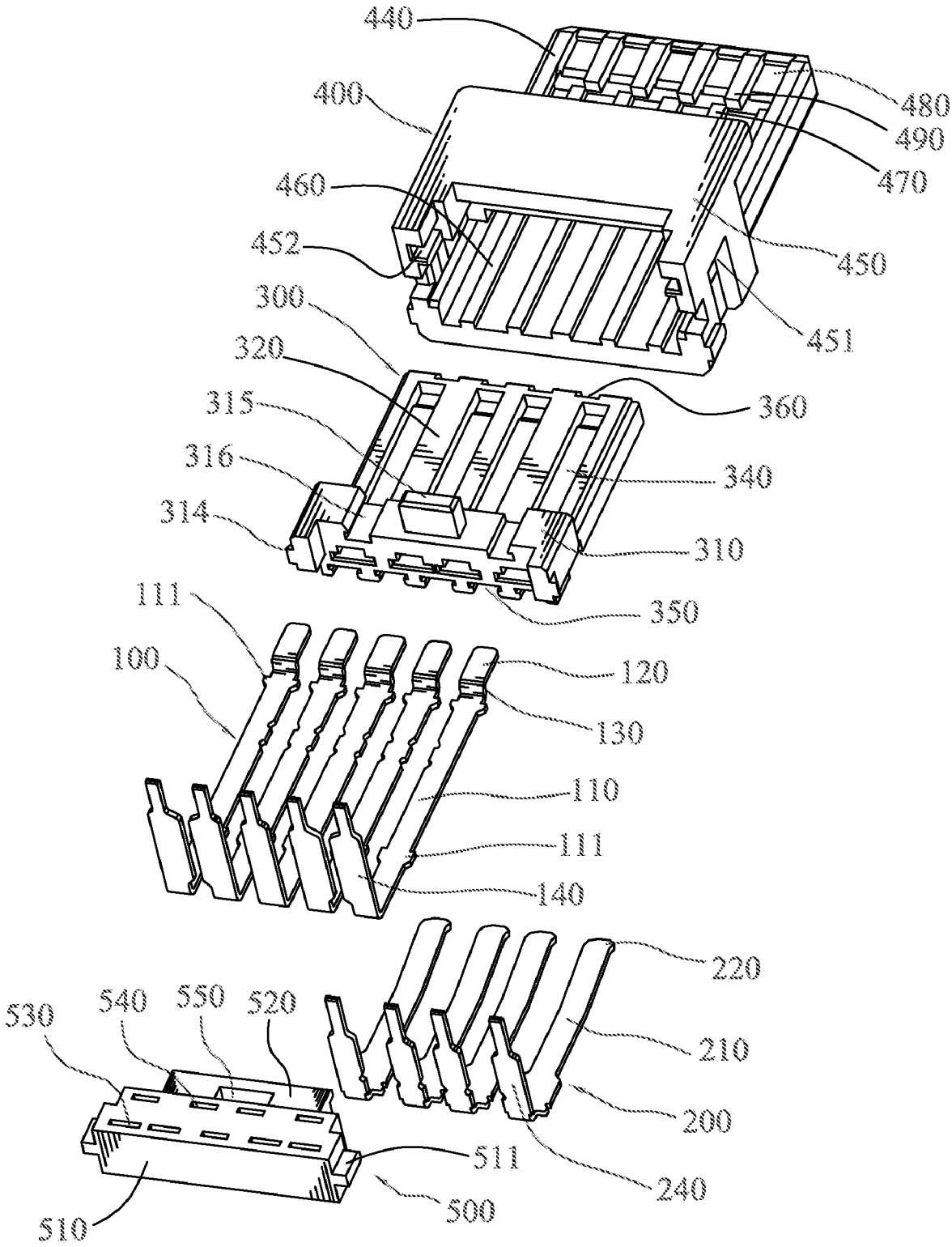
Figure 5:
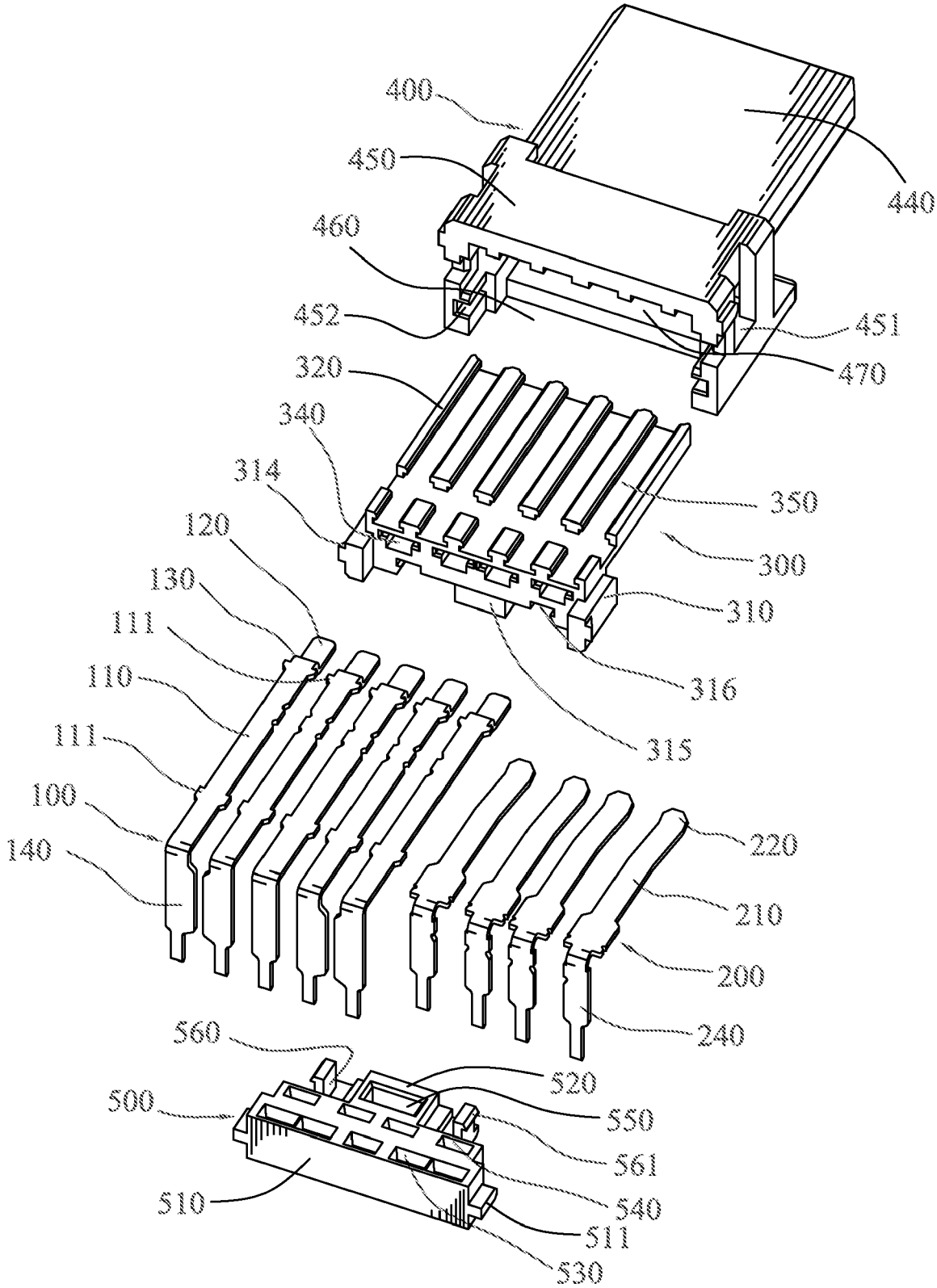

Referring to FIGS. 3-5, the insulating housing 400 has a rectangular base body 450 and a tongue board 440 extending forward from a lower portion of a front of the base body 450. A top of the tongue board 440 defines a rectangular receiving recess 470 extending longitudinally to penetrate through the base body 450. A front end of the top of the tongue board 440 defines a plurality of positioning cavities 480 arranged at regular intervals along a transverse direction of the tongue board 440 and communicating with the receiving recess 470. A portion between each two adjacent of the positioning cavities 480 protrudes rearward into the receiving recess 470 to form a restraining block 490. A rear of a top of the base body 450 defines a rectangular opening 460 connected with the receiving recess 470. A pair of locking fillisters 451 is opened in two opposite sides of the base body 450 with tops thereof being connected with the receiving recess 470, and a pair of fastening fillisters 452 is opened in two opposite sides of the opening 460 and penetrates through a rear end of the base body 450.

The insulating body 300 has a rectangular base portion 310 and a rectangular tongue portion 320 stretching forward from a bottom of a front of the base portion 310. A top surface of the tongue portion 320 defines a plurality of receiving cavities 340 arranged at regular intervals along a transverse direction of the tongue portion 320. A bottom surface of the tongue portion 320 defines a plurality of fastening cavities 350 arranged at regular intervals along the transverse direction of the tongue portion 320. The receiving cavities 340 and the fastening cavities 350 each extend longitudinally to penetrate through the base portion 310. A plurality of restraining grooves 360 is opened in a front end of the tongue portion 320 and spaced from one another along the transverse direction of the tongue portion 320. Two opposite sides of the base portion 310 oppositely protrude outward to form two locking barbs 314 at rear ends thereof. A top of the base portion 310 is provided with an inserting bolt 315 protruding upward from a middle portion thereof, and a pair of receiving fillisters 316 located at two opposite sides of the inserting bolt 315. A side of the receiving fillister 316 away from the inserting bolt 315 is designed with a guiding slope 317 at a top thereof and a buckling groove 318 at a bottom thereof. The buckling groove 318 communicates with the receiving fillister 316 and is located under the guiding slope 317.

Each of the first terminals 200 has a first fastening strip 210, a first contact portion 220 and the first soldering tail 240 which are connected with two opposite ends of the first fastening strip 210. The first soldering tail 240 is perpendicular to the first fastening strip 210, and the first contact portion 220 is slanted beyond a plane of the first fastening strip 210 towards a same direction as the first soldering tail 240. The first fastening strips 210 are respectively disposed in the receiving cavities 340 of the insulating body 300, and the first contact portions 220 project upward out of the corresponding receiving cavities 340. When an external mating connector is inserted into the electrical connector of the present invention, the first contact portions 220 are respectively pressed into the receiving cavities 340. The first soldering tails 240 are located behind the base portion 310 and aligned with one another to parallel a rear surface of the base portion 310.

Each of the second terminals 100 has a second fastening strip 110, a second contact portion 120 and the second soldering tail 140 which are connected at two opposite ends of the second fastening strip 110. The second contact portion 120 is connected with the second fastening strip 110 in a step manner by a connecting portion 130. The second soldering tail 140 is perpendicular to the second fastening strip 110 towards a same direction as the connecting portion 130. A plurality of fastening lumps 111 is oppositely protruded at two opposite side edges of the second fastening strip 110. The second fastening strips 110 are respectively secured in the fastening cavities 350 of the tongue portion 320, and the fastening lumps 111 are buckled in two opposite sides of the corresponding fastening cavity 350 to make the second terminal 100 be firmly secured in the insulating body 300. The second contact portions 120 project beyond the front end of the tongue portion 320 with the connecting portions 130 abutting against the front end of the tongue portion 320. The second soldering tails 140 are located behind the base portion 310 and aligned with one another to parallel the rear surface of the base portion 310. The second soldering tails 140 are farther away from the base portion 310 than the first soldering tails 240, in other words, the first soldering tails 240 are substantially located between the second soldering tails 140 and the base portion 310.

Referring to FIG. 3, FIG. 4 and FIG. 5 again, the lid 500 has a rectangular positioning body 510, and a fastening portion 520 protruding forward from a front of the positioning body 510. Two opposite sides of the positioning body 510 oppositely protrude outward to form a pair of fastening ears 511 corresponding to the fastening fillisters 452 of the insulating housing 400. The positioning body 510 defines a plurality of first positioning apertures 540 spaced from and aligned with one another along a direction perpendicular to the extending direction of the fastening portion 520, and a plurality of second positioning apertures 530 arranged at regular intervals in a row parallel the alignment of the first positioning apertures 540. Each of the positioning apertures 530, 540 extends vertically to penetrate through the positioning body 510. The row of first positioning apertures 540 are closer to the fastening portion 520 than the row of second positioning apertures 530, and located between the fastening portion 520 and the row of second positioning apertures 530. The fastening portion 520 are designed with an inserting hole 550 vertically penetrating through a middle thereof, and a pair of elastic arms 560 formed by two opposite ends of a top thereof oppositely protruding outward and then extending downward. Two bottom ends of the pair of elastic arms 560 oppositely protrude outward to form two buckling barbs 561.

Figure 6:
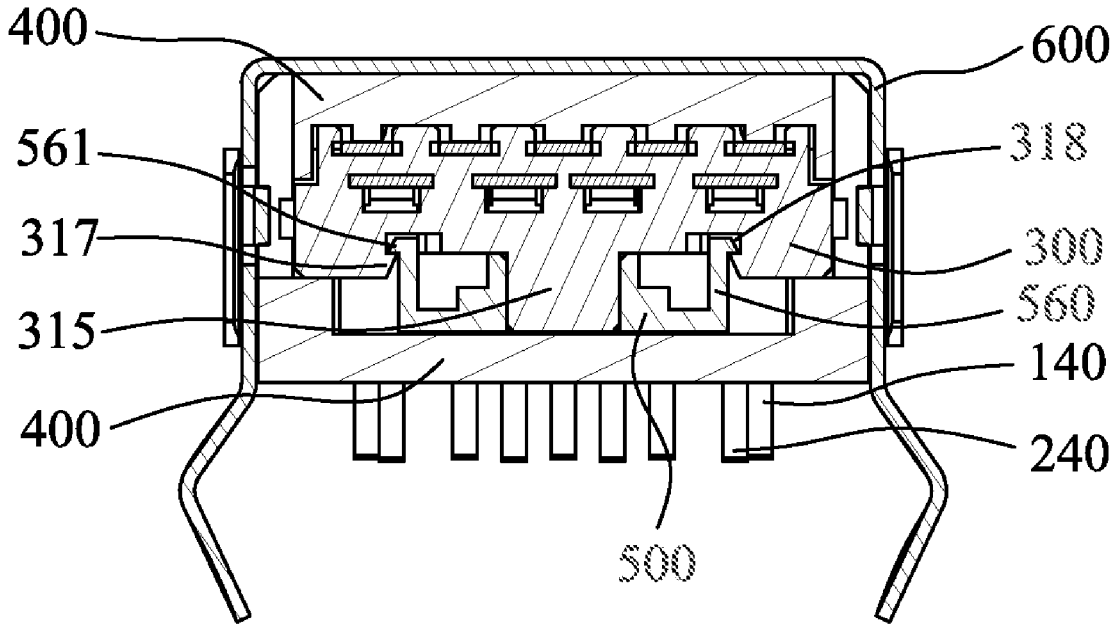
FIG. 6 is a cross-sectional view of the electrical connector of FIG. 1.

Referring to FIG. 2 and FIG. 6, when the lid 500 is mounted to the base portion 310 of the insulating body 300, the first soldering tails 240 and the second soldering tails 140 are respectively inserted into the first positioning apertures 540 and the second positioning apertures 530. Then the lid 500 is further pushed downward to make the inserting bolt 315 insert in the inserting hole 550 and the bottom ends of the elastic arms 560 received in the corresponding receiving fillisters 316, until the buckling barbs 561 slide downward along the guiding slopes 317 to be respectively buckled in the buckling grooves 318. At this time, the fastening portion 520 is propped against the top of the base portion 310 to ensure a firm assembly between the lid 500 and the insulating body 300. The positioning body 510 is located behind the base portion 310 to make the soldering tails 240, 140 be firmly positioned in the respective positioning apertures 540, 530. Free ends of the soldering tails 240, 140 project beyond a top of the positioning body 510.

Referring to FIGS. 1-6 again, when the insulating body 300 with the terminals 200, 100 and the lid 500 is assembled to the insulating housing 400, the tongue portion 320 is inserted forward into the receiving recess 470 until the restraining blocks 490 are respectively received in the restraining grooves 360 to restrain the insulating body 300 further moving forward. At this time, the connecting portions 130 of the second terminals 100 are clipped between the front end of the tongue portion 320 and a front side of the receiving recess 470, and the second contact portions 120 are positioned in the positioning cavities 480 respectively. The bottom surface of the tongue portion 320 abuts against a bottom side of the receiving recess 470 to further restrain the second fastening strips 110 in the respective fastening cavities 350. The base portion 310 is fastened in a rear of the receiving recess 470 by means of the locking barbs 314 being buckled in the corresponding locking fillisters 451 to prevent the insulating body 300 from moving rearward. The lid 500 is secured in the opening 460 of the insulating housing 400 by means of the fastening ears 511 being buckled in the fastening fillisters 452 respectively. The free ends of the soldering tails 240, 140 of the terminals 200, 100 further stretch out of the opening 460 and beyond the top of the base body 450 for being inserted into and soldered with a printed circuit board (not shown). The shielding shell 600 surrounds the insulating housing 400 so that not only can protect the insulating body 300, the lid 500, the insulating housing 400 and the terminals 200, 100 from harm, but also can shield the terminals 200, 100 from static electricity.

As described above, the electrical connector of the present invention utilizes the lid 500 to position the soldering tails 240, 140 of the terminals 200, 100 so as to strengthen the soldering tails 240, 140 and further prevent the soldering tails 240, 140 from deformation or fracture, when the soldering tails 240, 140 are inserted into the printed circuit board. So an accurate and efficient assembly can be achieved for the electrical connector and the printed circuit board.

What is claimed is:

1. An electrical connector, comprising:

an insulating body having a base portion and a tongue portion extending forward from a front of the base portion;

a plurality of terminals each having a fastening strip, a contact portion and a soldering tail connected with two opposite ends of the fastening strip, the soldering tail being substantially perpendicular to the fastening strip, the fastening strips being disposed in a top surface and a bottom surface of the tongue portion respectively and spaced from one another along a direction perpendicular to the extending direction of the tongue portion, the fastening strips further passing through the base portion to make the soldering tails stretch behind the base portion and further project upward beyond a top of the base portion; and a lid having a positioning body and a fastening portion protruding forward from a front of the positioning body, the positioning body defining a plurality of positioning apertures spaced from one another and each extending vertically to penetrate through the positioning body, the fastening portion being mounted to a bottom portion of the insulating body to make the positioning body locate behind the base portion, the soldering tails being respectively inserted in the positioning apertures to be positioned and strengthened by the positioning body, free ends of the soldering tails further projecting beyond a top of the positioning body;

wherein two opposite ends of a top of the fastening portion oppositely protrude outward and then extend downward to form a pair of elastic arms of which bottom ends oppositely protrude outward to form a pair of buckling barbs, two sides of the top of the base portion define a pair of receiving fillisters of which two outmost sides each is provided with a guiding slope at a top thereof and a buckling groove at a bottom thereof, the fastening portion of the lid is mounted to the bottom portion by means of the bottom ends of the elastic arms being inserted in the corresponding receiving fillisters and the buckling barbs sliding downward along the guiding slopes to be buckled in the buckling grooves.

2. The electrical connector as claimed in claim 1, wherein an inserting hole is opened to vertically penetrate through a middle of the fastening portion, a middle portion of the top of the base portion protrudes upward to form an inserting bolt inserted in the inserting hole.

3. The electrical connector as claimed in claim 1, wherein the terminals are divided into two groups, one group of terminals disposed in the top surface of the tongue portion are designated as first terminals, and the other group of terminals disposed in the bottom surface of the tongue portion are designated as second terminals, the contact portion of the first terminal is slanted upward beyond the top surface of the tongue portion, the contact portion of the second terminal is connected with one end of the fastening strip in a step manner by a connecting portion which abuts against a front end of the tongue portion to make the contact portion stretch beyond the front end of the tongue portion.

4. The electrical connector as claimed in claim 3, wherein the soldering tails of the first terminals and the soldering tails of the second terminals are arranged to two rows each paralleling the rear surface of the base portion, the positioning apertures of the lid are divided into two rows parallel to each other and perpendicular to the extending direction of the fastening portion for corresponding to the soldering tails.

5. The electrical connector as claimed in claim 3, further comprising an insulating housing which has a base body and a tongue board extending forward from a lower portion of a front of the base body, a top of the tongue board defining a receiving recess extending longitudinally to penetrate through the base body, a rear of a top of the base body defining an opening connected with the receiving recess, the tongue portion of the insulating body being inserted forward in the receiving recess to make the contact portions of the second terminals be positioned on a front of the tongue board, the connecting portions being clipped between the front end of the tongue portion and a front side of the receiving recess, the base portion being fastened in a rear of the receiving recess and the lid being secured in the opening, the free ends of the soldering tails further stretching beyond the top of the base body.

6. The electrical connector as claimed in claim 5, wherein two opposite sides of the base portion oppositely protrude outward to form two locking barbs, a pair of locking fillisters is opened in two opposite sides of the base body of the insulating housing with tops being connected with the receiving recess, the locking barbs are buckled in the tops of the locking fillisters respectively to prevent the insulating body from moving rearward.

7. The electrical connector as claimed in claim 5, wherein a pair of fastening fillisters is opened in two opposite sides of the opening and penetrates through a rear end of the base body, two opposite sides of the positioning body of the lid oppositely protrude outward to form a pair of fastening ears buckled in the fastening fillisters respectively.

8. The electrical connector as claimed in claim 5, wherein a plurality of restraining grooves is opened in the front end of the tongue portion and spaced from one another, a front side of the receiving recess protrudes rearward to form a plurality of restraining blocks respectively received in the restraining grooves to restrain the insulating body further moving forward.

* * * * *